US005079994A

United States Patent [19]

Berbuer

[11] Patent Number: 5,079,994

[45] Date of Patent: Jan. 14, 1992

[54] RADIAL PISTON MACHINE

[75] Inventor: Jürgen Berbuer, Aachen, Fed. Rep. of Germany

[73] Assignee: Vickers Systems GmbH, Bad Homburg, Fed. Rep. of Germany

[21] Appl. No.: 534,674

[22] Filed: Jun. 7, 1990

[30] Foreign Application Priority Data

Jun. 8, 1989 [EP] European Pat. Off. ..... 89110348.3

[51] Int. Cl.[5] ..... F01B 1/06

[52] U.S. Cl. ..... 91/491; 91/497; 91/498

[58] Field of Search ..... 91/491, 497, 498; 92/178, 179, 72

[56] References Cited

U.S. PATENT DOCUMENTS

| | | | |
|---|---|---|---|
| 3,084,633 | 4/1963 | Henrichsen | 91/498 |
| 3,087,437 | 4/1963 | Henrichsen | 91/498 |
| 3,357,362 | 12/1967 | Orr | 91/492 |
| 4,328,739 | 5/1982 | Rutz | 91/498 |
| 4,848,213 | 7/1989 | Wood | 92/172 |

*Primary Examiner*—Richard A. Bertsch
*Assistant Examiner*—Peter Korytnyk
*Attorney, Agent, or Firm*—Barnes, Kisselle, Raisch, Choate, Whittemore & Hulbert

[57] ABSTRACT

Radial piston machine as a fluid pump or fluid motor comprising an inner valving trunnion, an outer cam ring and at least a cylinder block arranged therebetween and having reciprocating pistons, which tilt when the cylinder block rotates. The pistons have spherical heads and crowned piston rings along the biggest diameter or equator in order to create each an oblique sealing plane when the respective piston is tilted. Pressure in each chamber limited by said oblique sealing plane will give rise to a direct transformation of torque and fluid pressure. The valving trunnion has enlarged sealing fields to get a precompression of the fluid between high and low pressure fluid areas in order to avoid excitation of noise. The machine design can be for constant or variable displacement. In case of variable displacement, the sinusoidal curve of piston travel is adjusted for a variable preceeding angle ($\epsilon$) by adding a constant eccentricity (c) so that the angle of the separation ($\tau$) is shifted in the direction of the extreme values of the piston travel curve, when there are large displacements, or to the slope of the piston travel curve, when there are small displacements in order to get a sufficient precompression.

5 Claims, 4 Drawing Sheets

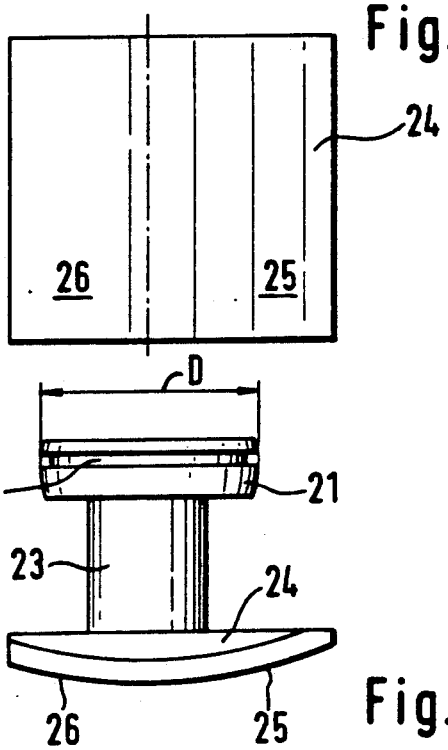
Fig. 3
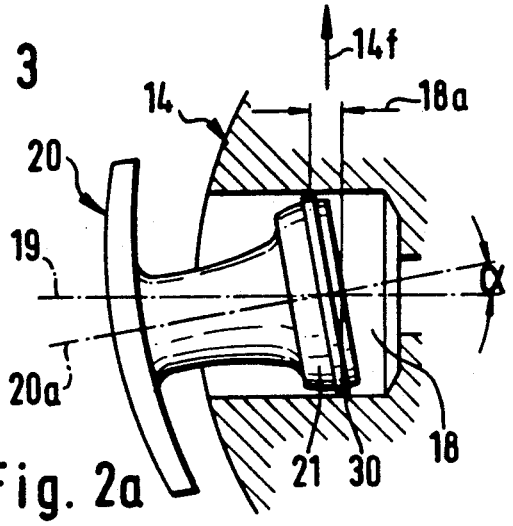
Fig. 2a
Fig. 4
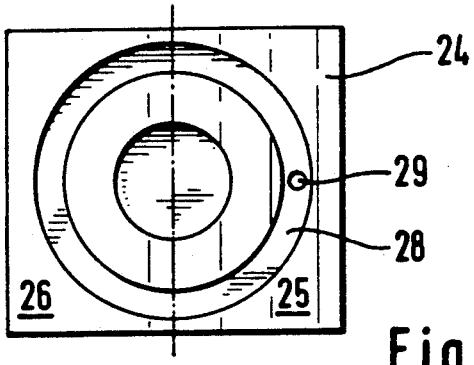
Fig. 5
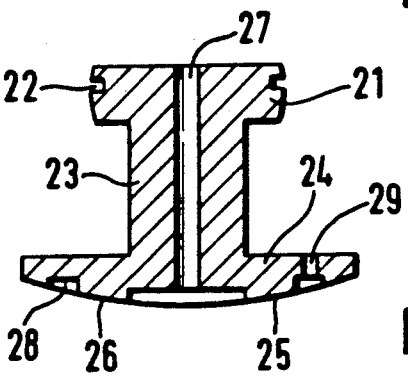
Fig. 6
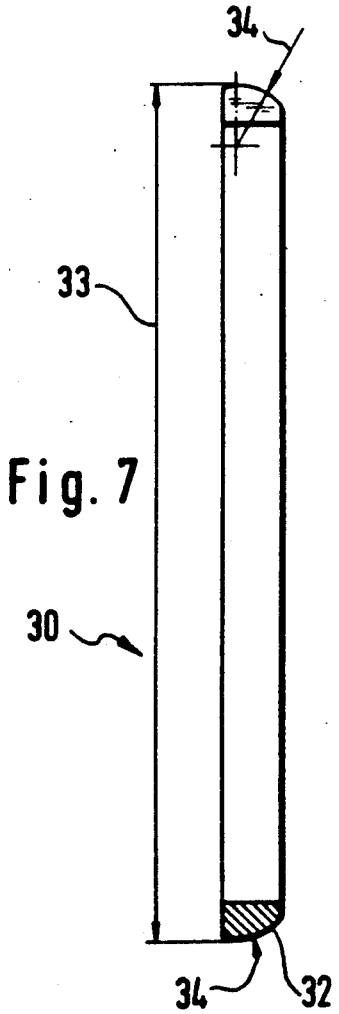
Fig. 7

RADIAL PISTON MACHINE

FIELD OF THE INVENTION

The invention relates to a radial piston machine as a fluid pump or motor and particularly to a radial piston pump for use in automotive cars.

BACKGROUND OF THE INVENTION

Radial piston pumps or motors, as mostly constructed, have a centrally arranged shaft driving a cam, which drives a number of radially arranged pistons. Also a reversed arrangement is known, see U.S. Pat. No. 3,087,437 to Henrichsen, where a centrally arranged pintle valve is for supplying and exhausting fluid to and from a number of cylinders in a rotating cylinder block, each cylinder including a reciprocating piston. The pistons are driven to and fro by an excentrically located cam ring, which surrounds the rotating cylinder block.

In a further known radial piston machine (pump or motor) of this kind (British patent 1 468 658, inventor: Kenneth Persival Palmer, assignee: Lucas Ltd.), the piston head is spherically shaped and has a ring groove in a certain distance to its equator plane, a piston ring being inserted in the ring groove. When the cylinder block is rotating, the pistons tilt and become inclined relatively to the axis of the cylinder bores so that also the piston rings will be oblique. One side of each piston ring travels further out of the ring groove, whereas the other side is further pressed into the ring groove. The piston ring has radially inner and outer edges, which engage the cylinder wall and produce end pressures, the end pressure at the side of the piston ring, which is shifted into the ring groove, is especially great and practically corresponds to the force, which produces the torque of the machine for the respective piston, having in mind the distance to the machine axis. Therefore, a high end pressure is met at this edge. On the other side of the piston ring, where it projects from the ring groove, this cantilevering portion under hydraulic pressure is under unfavourable bending stresses. Radial piston maschines of the type of the above named GB-A 1 468 658, therefore, cannot be met on the market.

OBJECTS AND SUMMARY OF THE INVENTION

Therefore, it is an object of the present invention to create a radial piston machine as pump or motor, wherein the end pressures of the piston ring are reduced.

It is a further object of the invention to provide a radial piston pump, wherein the torque of the machine is transferred directly in hydraulic pressure.

It is a further object of the invention to provide a radial piston motor, wherein the hydraulic pressure is directly transferred into torque.

It is a further object of the invention to provide a raidal piston machine as pump or motor, which is of small overall size, compared to radial piston maschines of same power.

It is a further object of the invention to provide a radial piston machine as pump or motor, which can be produced simply and economically.

It is a further object of the invention to provide a radial piston machine as pump or motor, which shows a silenced run.

It is a further object of the invention to provide a radial piston machine as pump or motor, which allows variation of the displacement.

In accordance with the invention, the radial piston machine comprises a valving trunnion provided with inlet and outlet passages leading to inlet and outlet grooves which are separated from one another by sealing fields, a cylinder block journalled relative to the valving trunnion and including a number of cylinder bores, each having a passage which cooperates, according to the rotational position of the cylinder block, with the inlet groove, the outlet groove or one of the sealing fields, each piston being tiltably guided within its cylinder bore and having a spherical piston head which limits a radially inwardly arranged working (pump of motor) chamber, each piston including a piston neck and a piston shoe to make up a total piston length which exceeds the length of each cylinder bore only by a small amount, the piston shoes cooperating with a cam ring which is eccentrically arranged to the cylinder block and produces the stroke of the pistons when the cylinder block rotates, whereby the pistons tilt and each working chamber included between piston head and cylinder bore is increasing at the inlet grooves and is decreasing at the outlet grooves, the piston head comprising a ring groove adjacent to its equator plane and at least a piston ring being inserted therein.

With this radial piston maschine, the direct transformation between torque and hydraulic pressure (and vice versa) is accomplished without further mechanical transferring members being necessary, solely based on the fact that the cylinders are sealed obliquely, that the sealing piston ring is arranged inclined to its cylinder bore and in such a manner that practically the pistons only feel axial forces.

With the construction according to the invention, the length of the cylinder bores is only a little longer than the stroke of the piston. Furthermore, the fluid can be supplied and exhausted through the centrally disposed trunnion saving space, that is inlet and outlet passages in radial outwardly casing members can be avoided. Production can be at low costs, since the parts are essentially rotationally symmetric, the pistons have a simple construction, and this is also true for the cylinder bores.

The biggest tilting angle $\alpha$ of the pistons is at piston position of 90° , if the zero position is supposed in the main plane of eccentricity. The amount of this tilting angle $\alpha$ depends from the extend of the eccentricity of cam ring, such eccentricity also being in relation to the cylinder length. With the design of the invention, maximum tilting angles $\alpha$ of approximately 10° can be reached. With the preferred embodiment of the invention, the tilting angle $\alpha$ reaches 7.75°.

Since the pistons take different oblique positions, sealing along a line by the piston ring is preferred, which can adapt the changing shape between the ellipse and circle and does not produce excessive end pressures. For this purpose, the edge adjacent to the piston neck of the ring groove for the sealing ring is arranged at the largest diameter ("the equator") of the piston head and the piston ring has a crowned conical outer surface therefor, the basic shape of the piston ring is conical, the piston ring being crowned at its biggest diameter.

The piston shoe which preferably is integral with the piston neck and piston head has a cylindrical bearing surface to slide and bear against the inner race of the cam ring. In the case of a pure hydrodynamic lubrication, the cylindrical bearing surface is asymmetrically connected through the piston neck to the piston head, that is the front bearing surface portion, seen in rotational direction is larger than the rear bearing surface portion. If the bearing surfaces of the piston shoes are lubricated from the respective working (pump or motor) chamber through a passage in the piston, also a symmetrical arrangement of piston shoe and piston head is feasable. This kind of lubrication has the advantage of balancing for end thrust which the pistons are subjected.

In order to lower acoustic noise, the fluid enclosed in the cylinder chamber by the sealing field can be prepressurized before being connected to the actual high pressure side or space of the machine. If the precompression corresponding exactly to the pressure within the high pressure space at the time of connecting, there is no exitation of sound conducted through solids. Therefore, the sealing field between low pressure and high pressure is made broader in rotational direction of the pump by an amount which is appropriate to produce a suitable precompression of the included pressure fluid. An adaption to different operational pressures can be made by transition slots in the sealing fields.

If the radial piston machine is for variable displacement, this means that the respective piston strokes eventually are made smaller and therefore also the precompression pressure should be reduced together with the reduced displacement. According to the invention, the cam ring of the radial piston machine is adjusted tangentially along a guide which is arranged so as to direct the eccentricity of the cam ring in a certain manner aroung an orbital path, which has an effect like an adjustment of the preceeding angle, the zero position of cylinder block and valving trunnion. Particularly, the cam ring can be adjusted tangentially along a guide by a first amount of eccentricity and the distance of the guide perpendicular to the axis of the cylinder block is made smaller by a second amount of excentricity than the diameter of the cam ring. Surprisingly, by these features an approximately constant precompression interval is obtained independently from the setting of displacement of the maschine.

In the case of radial piston machines where the dead volume varies with displacement setting, the second amount of eccentricity can be changed dependent upon stroke, if necessary, by the guide of the cam ring obtaining a sloped engaging surface.

The new radial piston machine can be designed with one or a plurality of disks, that is two or more cylinder blocks arranged side by side can be provided, rotating about the same valving trunnion and being connected with one another by clutch means.

SHORT DESCRIPTION OF THE DRAWINGS

Figure 2:
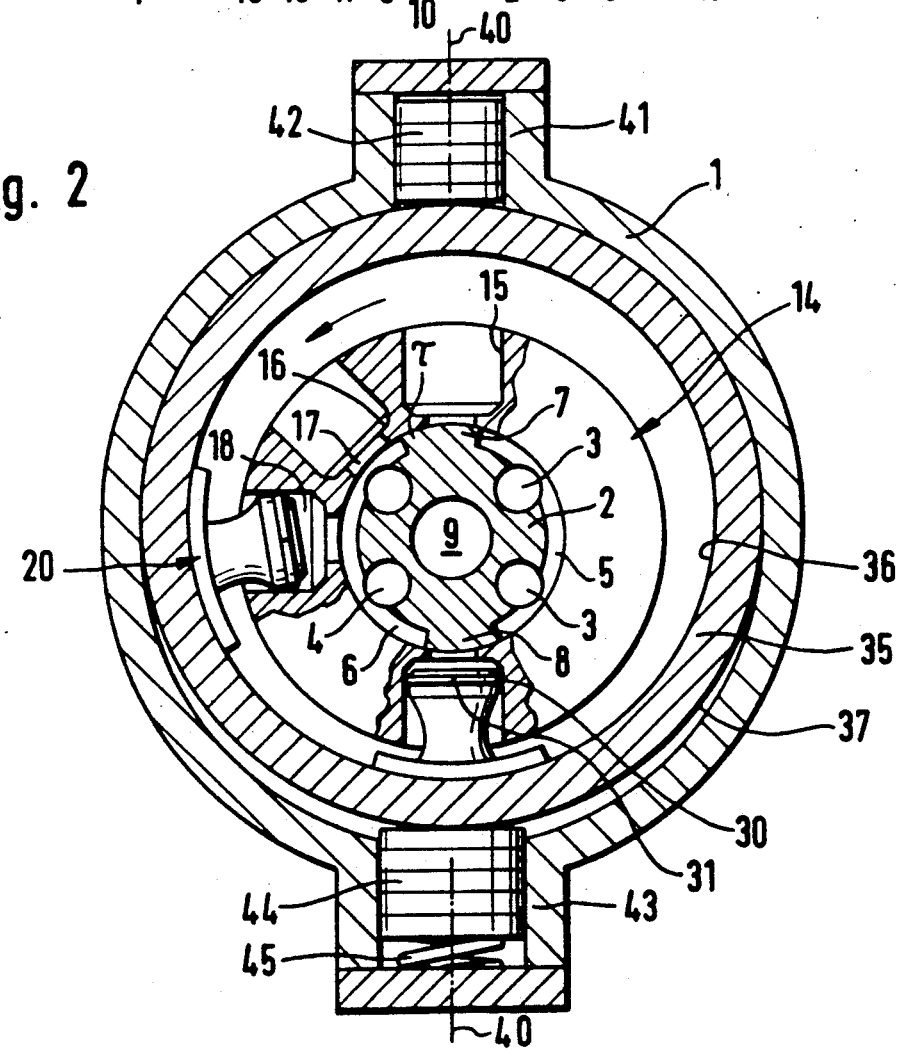
FIG. 2 is a radial cross section, schematically.

FIG. 2*a* shows a detail of FIG. 2 on enlarged scale,

FIG. 3 is a view onto a piston from the side of the piston shoe and

FIG. 4 an elevational view of this piston,

FIG. 5 is a view on an alternate piston shoe and

Figure 8:
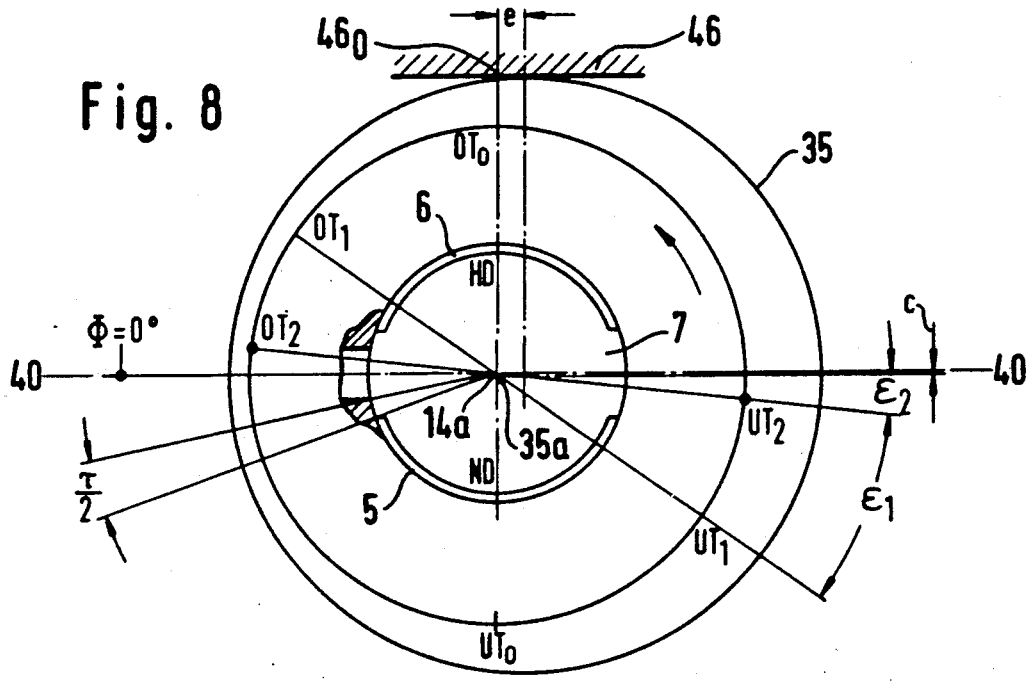
Figure 9:
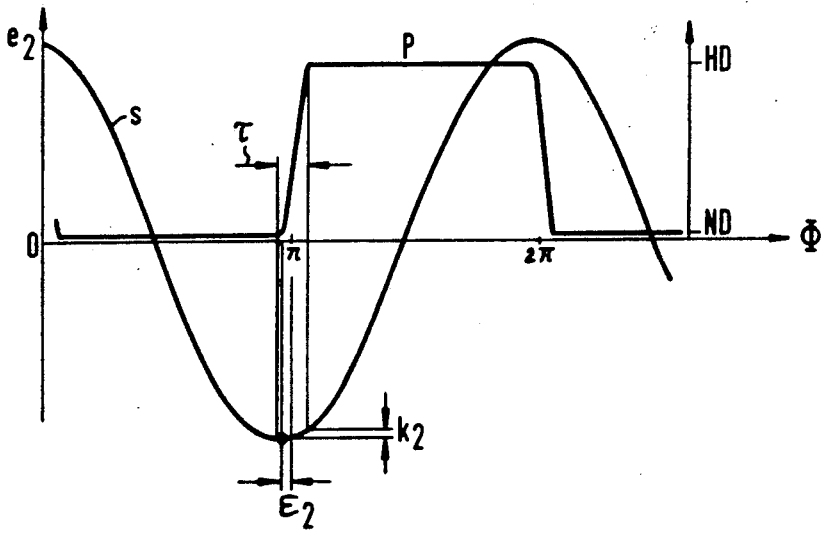
Figure 10:
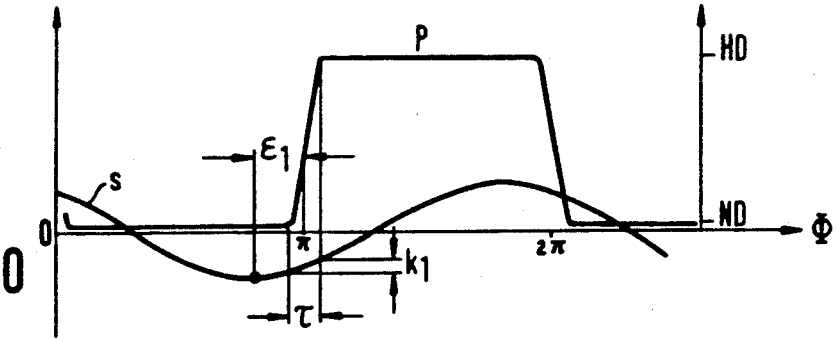
Figure 11:
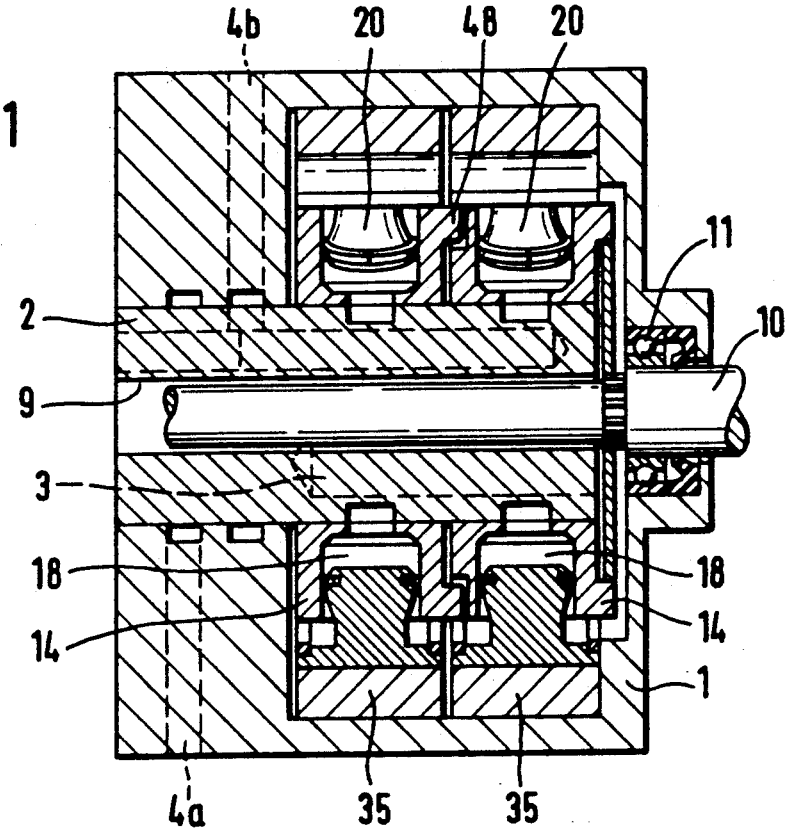
Figure 12:
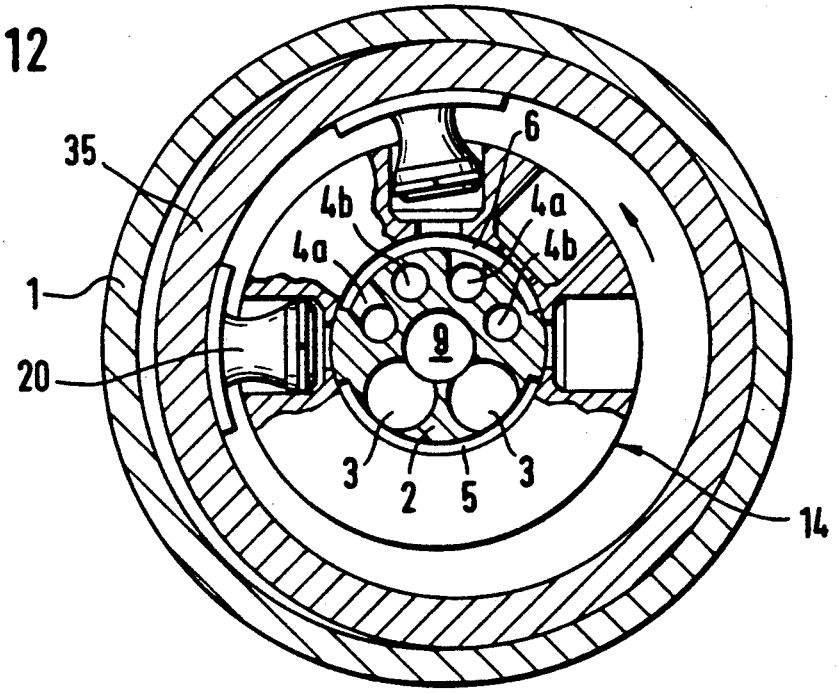

FIG. 6 is a sectional view of this piston,

FIG. 7 is a cross sectional view of a piston ring on enlarged scale,

FIG. 8 is a schematic view of a cam ring guide,

FIG. 9 is a diagram of piston stroke and of pressure produced over rotational angle for a single cylinder at large pumping volumes, FIG. 10 is a similar diagram, however, for a small pumping volume, FIG. 11 is a longitudinal section through a radial piston pump having two cylinder blocks, and FIG. 12 is a cross sectional view of the pump in FIG. 11.

DETAILED DESCRIPTION OF THE EMBODIMENTS OF THE INVENTION

Figure 1:
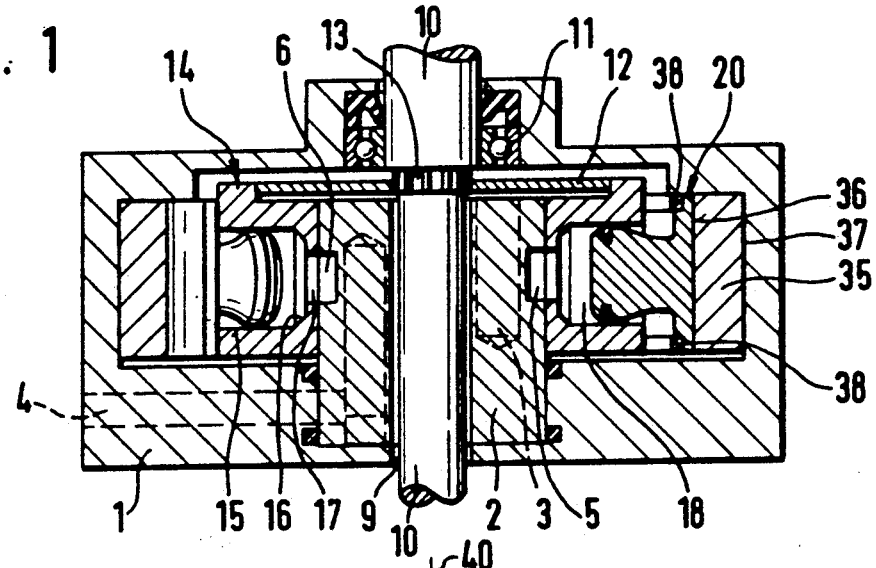
FIG. 1 shows a longitudinal cross section of a radial piston pump.

Referring to FIGS. 1 and 2, a valving trunnion 2 is sealingly arranged within a casing 1. Inlet passages 3 and outlet passages 4 lead to inlet grooves 5 and outlet grooves 6, respectively. Grooves 5 and 6 are separated from one another by sealing fields 7 and 8. The valving trunnion 2 also comprises a centrally arranged bore 9, where a shaft 10 passes through to drive a further device not shown. The shaft 10 is journalled in bearings 11 within casing 1 and is coupled to a driving disk 12 by splines 13 or similar. The driving disk 12 is connected to a cylinder block 14, provided with a number of radially extending cylinder bores 15 only four thereof being shown. The bores 15 have bottoms 16, each provided with a passage or openings 17. The number of the cylinder bores 15 can be chosen freely within limits, that is even and odd numbers of cylinders can be used. A number $Z=8$ is preferred for being a good compromise between small structural size and small pulsations of volume flow and furthermore, offering enough space for the valving trunnion 2.

Within every cylinder bore 15, a one piece piston 20 is guided, having a spherical piston head 21, a piston groove 22, a piston neck 23 and a piston shoe 24. The groove 22 is arranged along the biggest diameter of the spherical piston head 21 and in particular the rim of the groove 22 which is adjacent to the neck is arranged along the equator of the piston head 21.

Referring to FIGS. 3 and 4, the piston shoe 24 has a rectangular perimeter and a cylindrical bearing surface, the latter having a larger front bearing surface portion 25 and a smaller rear bearing surface portion 26. The portions in area of these both surface portions are 58 and 42%, respectively. Shoe 24 is asymmetrically connected to neck 23 and head 22. This structure is used with hydrodynamic lubrication, since the lift at the rear bearing surface portion 26 is somewhat higher than at the front bearing surface portion 25.

Referring to FIGS. 5 and 6, the bearing surface portions 25 and 26 can also be arranged symmetrically, above all, when a lubricating duct 27 connects the pumping chamber 18 and the bearing surface portions 25, 26 to one another. The bearing surfaces 25, 26 can be divided by a circular groove 28, limiting an area corresponding to that of head 21 and being connected through a relieving bore 29 with low pressure, for balancing purposes.

A slotted piston ring 30 (FIG. 7) is inserted into ring groove 22, the slot 31 being shown in FIG. 2 allowing elastically changing the shape of the piston ring 30. This is necessary, because the piston head 21 is tilted within the cylinder bore 15 and the piston ring 30, therefore, must be able to change from circular shape to the shape of an ellipse, whereby the outer piston ring surface 32 shifts and pivots to the cylinder wall. Furthermore, the fluid pressure acts upon the piston ring form outwardly and also from the direction of the ring groove 22. For balancing the fluid pressure onto the piston ring, a trapezoid cross sectional shape of the piston ring 30 would have to be preferred. However, in order to reduce wear due to the above movements of shifting and pivoting and also for allowing hydrodynamic lubrication of the piston ring 30, the latter is crowned in the region of its biggest diameter 33, as best can be seen in FIG. 7 at 34. For reason of production, the crowning radius can be continued to the smaller diameter of the piston ring 30.

The piston shoes 24 cooperate with a cam ring 35 (FIGS. 1 and 2) having an inner race 36 and an outer surface 37. The inner race 36 is eccentrically arranged to the cylinder block 14 and therefore transmits a lifting movement onto the pistons 20, when the cylinder block rotates. The reverse stroke is produced by down holder rings 38, engaging in peripheral grooves at the inner side of the piston shoes 24, a positive guide being obtained in total. The pumping chamber 18 included between piston head 21 and cylinder wall 15 is increasing at the inlet grooves 5 and is narrowing at the outlet grooves 6. By this effect, fluid on the side 5 is sucked and at the side 6 is displaced, resulting in the pump flow.

In the case of a motor, the inlet 3, 5 is on high pressure, whereas the outlet 4, 6 is on low pressure, the fluid driving the cylinder block 14, the disk 12 and the shaft 10.

FIG. 2*a* is a view on enlarged scale of the piston 20 and its pumping chamber 18 shown on the left side of FIG. 2. As can be seen, the piston head 21 with its piston ring 30 is inclined by an angle $\alpha$ to the radially extending axis 19 of the cylinder bore. The pump chamber 18 therefore has a generally trapezoid section in a plane extending along the cylinder bore axis. The parallel limbs of the trapez have different lengths, the upper limb being longer by the distance 18*a* than the lower limb in FIG. 2*a*. Since in chamber 18 is a hydraulic pressure acting to all sides, a force 14*f* is acting upon the cylinder block 14 according to the size of the area 18*a* and the pressure in chamber 18, the force 14*f* being a component to the torque onto the cylinder block 14. In case of a pump, this counter torque is the equivalent of the pressure rise in pump chamber 18 and in case of a motor, the torque in question is a corresponding portion of the motor torque. As an important feature, the piston 20 is acted upon by the sum of the hydraulic forces in its axial direction, that is in direction of the line 20*a*. This means that in case of a pump the driving torque is transformed directly in a pressure rise of the fluid being pumped, whereas, in case of a motor, the fluid pressure is directly used to produce the motor torque, no mechanical transmission members being interposed.

If a maximum pumping volume of $V=12$ cm$^2$ per rotation is to be obtained with a piston number $Z=8$, then a piston diameter $d=16$ mm and an eccentricity of $e=3.7$ mm are needed. With such a radial piston machine, the pistons 20 must allow oblique positions until $\alpha=7.75°$. If eccentricity is increased and therefore also the piston stroke, the degree of maximum oblique position increases, too. It is supposed that the system described allows maximum tilting angles $\alpha$ of 10°.

As can be taken from FIG. 2, the sealing field 7 and 8 each are broader than the width of the openings or passages 17 by an amount $\tau$. Seen from the zero position, the amount or angle of separation $\tau$ is shifted in the direction of rotation of the cylinder block 14. When the rotating pump chambers 18 are travelling over the sealing field 7, the piston 20 begins to pressurize the included fluid before this fluid becomes connected to the groove 6 where high pressure is present. If this precompression corresponds exactly to fluid pressure in groove 6, where is no pressure release or shock and therefore, no exitation of acustic noise. It is therefore intended to design the machine in such a way that the amount of precompression corresponds to the desired pump pressure. Deviation can be matched by grooves or slots in the area $\tau$, so far these deviations are not too large.

The sealing fields 7, 8 may also be arranged symmetrically to the plane 40—40, the enlarging areas $\tau$ then being arranged on both sides.

As FIG. 2 shows, the radial piston pump as described can be constructed as a variable displacement pump. The displacement setting system acts along the displacement setting plane 40—40 and includes a small cylinder 41, having a small displacement setting piston 42, and a bigger displacement setting cylinder 43 having a bigger piston 44 and a spring 45. The small piston 42 is always acted upon by pump pressure, and the big piston 44 is under control pressure, which is smaller than the pump pressure. Control may be for a constant pumping volume or a constant pumping pressure, the particularity thereof need not be described. Generally, there are setting movements of the cam ring 35 and therefore, changed eccentricities e and changed amounts of precompression which, therefore, are mismatched to the system.

Referring to FIGS. 8 through 10, it is shown how this problem is solved. A guiding surface 46 is provided within casing 1 for a cam ring 35, which engages the guiding surface 46 and may take several eccentric positions. The distance between surface 46 and rotational axis 14*a* of the cylinder block, that is the length $46_0$–14*a* is smaller than the radius of the outer surface 37 of the cam ring 35 engaging the guiding surface 46. In this position of the cam ring 35, which generally is said to be a zero stroke position, the center 35*a* of the cam ring does not coincide with the rotational axis 14*a* of the cylinder block, but has a distance c which is a so-called "constant" eccentricity. In the zero stroke position, there is an upper dead center $OT_0$ and a lower dead center $UT_0$ deviating by 90° to the displacement setting plane 40. At this position, no fluid is pumped, since the pistons 20 move symmetrically to and/or the grooves 5 and 6, respectively.

If now the cam ring 35 is shifted in FIG. 8 to the right hand side by an amount el of eccentricity, the upper and lower dead centers travel to the positions $OT_1$ and $UT_1$ and a small volume is pumped as shown in FIG. 10.

If the cam ring 35 is further moved into its end position, the upper and lower dead centers are shifted to $OT_2$ and $UT_2$. Starting from the main eccentricity plane 40—40, the rotational angle of the cylinder block is called $\Phi$. The angle position of the lower dead center before reaching the main eccentricity plane at $\Phi=180°$ is called preceeding angle $\epsilon$. The difference in angle between width of the sealing field 7 and the width of the opening 17 is the angle of separation $\tau$. If a cylinder 15 is passing along this angle of separation $\tau$, the pressure p in the cylinder is increasing from low pressure ND to high pressure HD. In order that this pressure increases steadily, an appropriate precompression of the enclosed volume of the cylinders in the area of the angle of separation is needed. For this purpose, the piston 20 should move by a precompression distance k when passing along the angle area $\tau$, though the radial velocity of the piston 20 depends from the pumping volume and therefore, different precompression distances appear inavoidable. Correction of the radial piston velocity in the area of angle $\tau$ is accomplished merely by the cooperation of the constant eccentricity c with the variable eccentricity e. It can be written: e=arc tan c/e.

For large pumping volumes, the preceeding angle $\epsilon$ is small and for small pumping volumes it is large. In the diagrams of FIGS. 9 and 10, this means shifting the sinusoidal curve of the piston travel s to a greater or lesser degree to the left side, namely a more shifting degree $\epsilon 1$ at smaller pumping volumes and a smaller shifting degree $\epsilon 2$ at larger pumping volumes. Accordingly, at large pumping volumes, the curve s of piston travel crosses the angle $\tau$ of separation adjacent to the range of an extreme value, whereas at smaller pumping volumes the curve s is shifted more to the slope of the curve s, as the comparison between FIGS. 9 and 10 reveals. In other words, the greater radial velocity of the pistons far from the extreme positions is used to obtain a sufficient great precompression distance k1 when there is a small pumping volume. The precompression distances k1 and k2 can be made equal, however, it is also possible to make k1 larger, as shown in FIG. 10, in order to compensate for the relative greater leakage with smaller pumping volumes.

In order to compensate for dead volumes, it may be appropriate to vary the "constant" eccentricity c by a sloped guide 46. Such a sloped guide can comprise straight and curved portions.

By the way, the amount of the constant eccentricity is very small. For a precompression pressure of 140 bars, a compensation compression module of 14,000 bars for oil, a dead volume of 1.5 $cm^3$, a cylinder diameter of 1.6 cm and an angle separation of 10°, a constant eccentricity of c=0.43 mm is obtained. It is feasable to adjust the guide surface 46 by fine thread means, to find the optimal value of the constant eccentricity c by measuring minimum noise.

FIGS. 11 and 12 show that the radial piston pump can be designed for two and more cylinder blocks 14. The several cylinder blocks are coupled for their rotational movement by dogs 48 or similar, whereas some radial movement is possible between the cylinder blocks. In the embodiment shown, two common inlet passages 3 are provided, whereas outlet passages 4a, 4b are separated for both pumping disks. It is to be understood that the bore 9 for the shaft 10 is not absolutely necessary, so that this space could be used for fluid ducts.

I claim:

1. A radial piston machine for transmitting fluid power comprising a casing, a cam ring, cylinder block means, shaft means, piston means and a valving trunnion, said trunnion having fluid inlet means and fluid outlet means which are separated by sealing fields, said cylinder block means being connected to said shaft means and rotatably journalled to said valving trunnion and including a number of cylinder bores, each having a radial inner end and an opening therein that, according to the rotational position of the cylinder block, cooperates with said inlet means, said outlet means or one of said sealing fields, said piston means including each a piston for each cylinder bore belonging thereto, each said piston having a spherical piston head, a neck and a shoe with a cylindrical bearing surface, each said spherical piston head having a biggest diameter at an equator plane, a ring groove adjacent to said equator plane and at least a piston ring inserted in said ring groove, each said head being tiltably guided for a limited tilting angle ($\alpha$) within said cylinder bore to which the respective piston belongs and limiting each a working chamber arranged at said radial inner end of said cylinder bore, said cam ring having a center and an inner race with a radius corresponding to said cylindrical bearing surface of said shoe, said inner race being eccentrically arranged to said cylinder block and cooperating with said piston shoes to transmit stroke movements onto said pistons when said cylinder block means rotates, whereby the pistons are tilted by said angle ($\alpha$) and each said working chamber included between piston head and cylinder bore is increasing adjacent to said inlet means and decreasing adjacent to said outlet means, wherein said piston shoe has a first, front and a second, rear cylindrical bearing portion asymmetrically connected to said piston head through said piston neck, said first bearing portion having a larger area than said second bearing portion.

2. Radial piston machine set forth in claim 1 wherein said cam ring is adjustable along a guide by a first amount (e) of eccentricity and wherein the perpendicular distance of said guide to said axis of said cylinder block is smaller by a second amount (c) of eccentricity than is said radius of said cam ring outer race.

3. Radial piston machine set forth in claim 2 wherein said guide is sloped so as to guide said center of said cam ring in a variable distance to said sealing fields.

4. A radial piston machine for transmitting fluid power comprising a casing, a cam ring, cylinder block means, shaft means, piston means and a valving trunnion, said trunnion having fluid inlet means and fluid outlet means which are separated by sealing fields, said cylinder block means being connected to said shaft means and rotatably journalled to said valving trunnion and including a number of cylinder bores, each having a radial inner end and an opening therein that, according to the rotational position of the cylinder block, cooperates with said inlet means, said outlet means or one of said sealing fields, said piston means including each a piston for each cylinder bore belonging thereto, each said piston having a spherical piston head, a neck and a shoe with a cylindrical bearing surface, each said spherical piston head having a biggest diameter at an equator plane, a ring groove adjacent to said equator plane and at least a piston ring inserted in said ring groove, each said head being tiltably guided for a limited tilting angle ($\alpha$) within said cylinder bore to which the respective piston belongs and limiting each a working chamber arranged at said radial inner end of said cylinder bore, said cam ring having a center and an inner race with a radius corresponding to said cylindrical bearing surface of said shoe, said inner race being eccentrically arranged to said cylinder block and cooperating with said piston shoes to transmit stroke movements onto said pistons when said cylinder block means rotates, whereby the pistons are tilted by said angle ($\alpha$) and each said working chamber included between piston head and cylinder bore is increasing adjacent to said inlet means and decreasing adjacent to said outlet means, the width of each sealing field being larger by an amount ($\tau$) than the width of said opening to said working chamber, said cam ring being adjustable along a guide by a first amount (e) of eccentricity and wherein the perpendicular distance of said guide to said axis of said cylinder block is smaller by a second amount (c) of eccentricity than is said radius of said cam ring outer race.

5. Radial piston machine set forth in claim 4 wherein said guide is sloped so as to guide said center of said cam ring in a variable distance to said sealing fields.

* * * * *